United States Patent [19]

Chow

[11] 4,290,056

[45] Sep. 15, 1981

[54] PROTECTIVE SYSTEM

[75] Inventor: Vincent Y. S. Chow, Hanover Park, Ill.

[73] Assignee: Ellsworth, Chow & Murphy, Inc., Palo Alto, Calif.

[21] Appl. No.: 54,859

[22] Filed: Jul. 5, 1979

[51] Int. Cl.[3] ..... G08B 25/00

[52] U.S. Cl. ..... 340/538; 340/310 R; 340/524

[58] Field of Search ..... 340/506, 524, 531, 533, 340/538, 310 R

[56] References Cited

U.S. PATENT DOCUMENTS

| | | | |
|---|---|---|---|
| 3,148,365 | 9/1964 | Voight et al. . | |
| 3,334,340 | 8/1967 | McConnell . | |
| 3,388,389 | 6/1968 | Henriques . | |
| 3,460,121 | 8/1969 | Wattenburg . | |
| 3,482,243 | 12/1969 | Buchsbaum . | |
| 3,641,547 | 2/1972 | Reiss et al. | 340/533 |
| 3,686,439 | 8/1972 | Gerald | 340/506 |
| 3,689,886 | 9/1972 | Durkee . | |
| 3,810,096 | 5/1974 | Kabat et al. . | |
| 3,818,466 | 6/1974 | Honda | 340/310 R |
| 3,922,664 | 11/1975 | Wadsworth | 340/538 |
| 3,961,322 | 6/1976 | Lichtblau . | |
| 3,974,492 | 8/1976 | Girismen . | |
| 4,024,528 | 5/1977 | Boggs et al. . | |

*Primary Examiner*—Alvin H. Waring

*Attorney, Agent, or Firm*—Neuman, Williams, Anderson & Olson

[57] ABSTRACT

A domestic protective system which utilizes existing household AC power lines to conduct system signals between remote stations or zones and a master receiver. The system signals are established by a single carrier frequency and include a data pulse of this frequency under normal conditions, and no data pulse under malfunction conditions. Locations of zones originating system data signals are identified by time delays established prior to data transmission from each zone, this delay triggered and synchronized by data transmissions transmitted from other zones.

21 Claims, 8 Drawing Figures

PROTECTIVE SYSTEM

BACKGROUND OF THE INVENTION

This invention relates generally to domestic protective systems and, in particular, to improvements in alarm systems which utilize existing AC power lines to conduct system signals.

In recent years, protective systems including provisions for security and fire alarms, have become extremely popular for domestic use and thus have had increasing commercial importance. Because of the vigorous competition in the field, the addition of features incorporated in current systems, improvements in quality and reliability, and in reducing the expense of installation and maintenance of current systems have all become very important.

One significant technique in reducing the expense of installation in protective systems is to utilize AC power lines, as already exist in the home, to conduct system signals. In this manner, the expense and installation of wires is completely eliminated in connecting the various monitored remote stations or alarm zones to each other and/or to a master receiver. One example of such a system utilizing AC power lines is disclosed in Wadsworth, U.S. Pat. No. 3,922,664.

Once a protective system has been designed utilizing existing AC power lines, it is further preferable to have circuitry which will provide the user with more information than has been obtainable in past systems, including identification of normal operation, identification of the location of any stations or zones in alarm, and identification of any malfunction of remote sensors with an identification of the location of the malfunctioning zone. In addition to providing this information, it is desirable to maintain a reliable system with high noise immunity and minimal potential for false alarms, and a system that can be maintained and expanded, if necessary, with minimal cost. These additional features have heretofore been unavailable in relatively low cost domestic protective products.

SUMMARY OF THE INVENTION

Accordingly, the present invention provides an improved domestic protective system which utilizes existing AC power lines to conduct system signals thereby maintaining a low installation cost and which further provides quality features which have heretofore been unavailable in other domestic protective products. The invention provides a system which utilizes a data transmission pulse comprised of a single carrier frequency imposed upon the AC line current to transmit between remote zones and a master receiver, use of this single frequency eliminating the problems and malfunctions typical in multi-frequency devices. For each specific remote zone, information is transmitted identifying a normal condition (by the presence of a data pulse with the single carrier frequency imposed on the AC line), an alarm condition (by a data pulse with modulation of the single carrier frequency) and a malfunction condition at the remote zone (by no data pulse imposed on the AC line). The specific zone being monitored and transmitting data is identified by a selected time delay prior to its data transmission pulse.

The time delay prior to data transmission from each monitored remote zone is triggered and synchronized by the end of a data transmission from a prior remote zone as opposed to any pattern or synchronization wired into the master receiver. In this fashion, by self-synchronization between remote zones, extra zones may easily be added to expand the system without extensive installation cost or extensive wiring required and longer delay periods, established in part by the delays of other zones, can be accomplished with minimal component cost.

It is an object of the present invention to provide a functionally improved and reliable domestic protective system which can be installed and maintained with minimal expense.

It is a further object of the present invention to provide an improved protective system which utilizes existing AC power lines to conduct system signals.

It is another object of the present invention to provide an improved protective system capable of providing extensive information to the user as specified above yet utilizing only a single carrier frequency data transmission pulse.

It is yet another object of the present invention to provide an improved protective system which can be easily expanded to incorporate additional monitored remote zones.

It is another object of the present invention to provide an improved protection system in which each remote monitoring zone transmits data in a synchronized pattern triggered by the end of a data transmission from a prior remote zone.

It is still another object of the present invention to provide an improved protective system with relatively high noise immunity and minimal potential for false alarms.

Further objects and advantages of the present invention will become apparent as the following description proceeds and the features of novelty which characterize the invention will be pointed out with particularity in the claims annexed to and forming a part of this specification.

BRIEF DESCRIPTION OF THE DRAWINGS

FIG. 4 is shown in three parts, FIGS. 4*a*, 4*b* and 4*c*, for convenience of drawing. The complete schematic may be seen by placing FIG. 4*b* beneath FIG. 4*a* and arranging FIG. 4*c* to the right of the combination of FIG. 4*a* and FIG. 4*b*. The interconnection between the circuitry shown in the three figures, represented by corresponding circled letters, will be evident when they are so arranged.

DESCRIPTION OF THE PREFERRED EMBODIMENT

Figure 1:
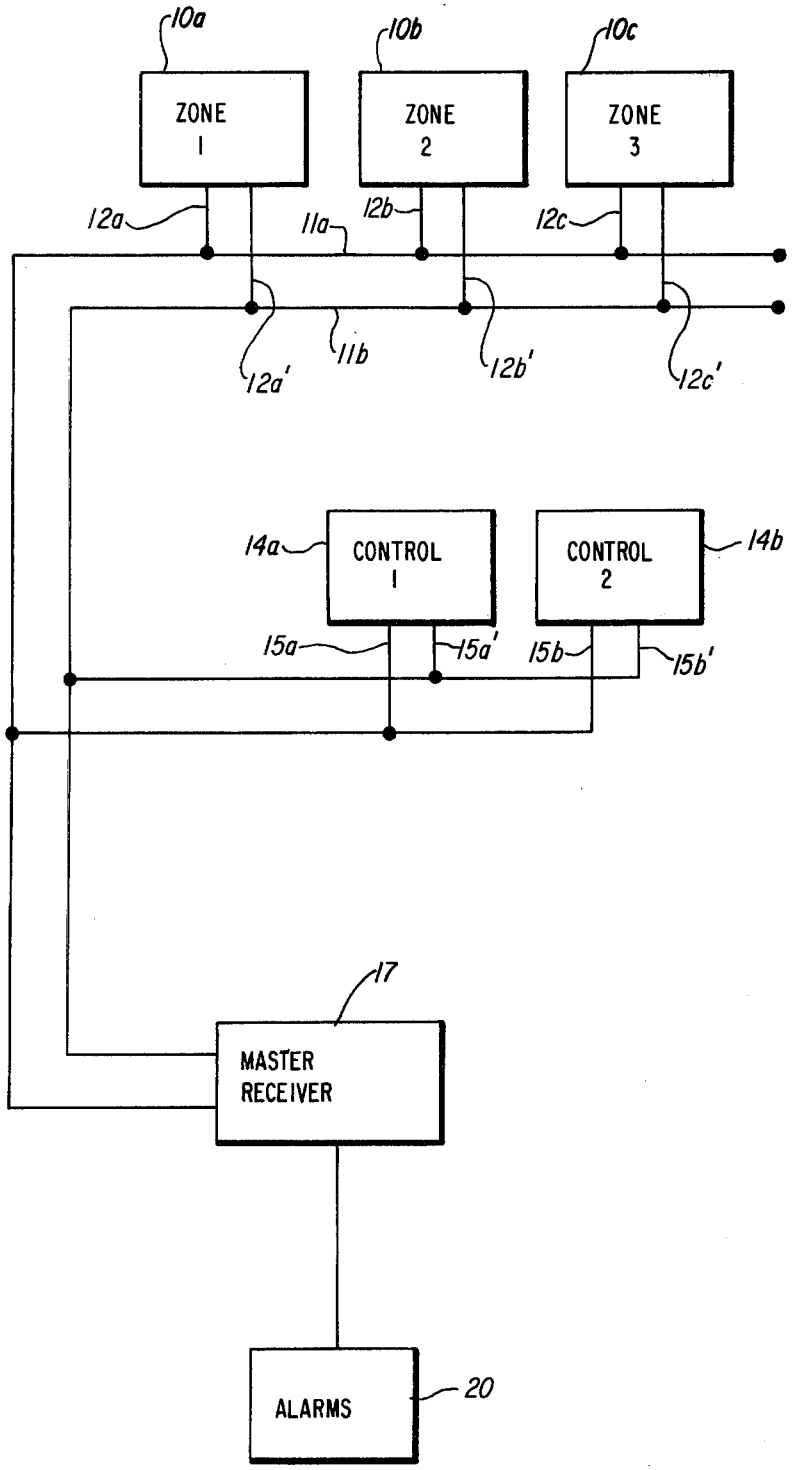
FIG. 1 is a block diagram for the protective system of the present invention.

Referring now to the drawings wherein like reference characters designate corresponding parts throughout several views, there is shown in FIG. 1 a block diagram of a protective system which may make use of the present invention. Up to 14 remote zones or stations may be monitored by a present embodiment of the invention to be described, three of which are shown in FIG. 1 and referenced as 10*a*, 10*b* and 10*c*. Each zone may contain several trip circuits as will be described below, each trip circuit comprising a specific monitored section within the zone, such as a window or door within a room or a fire or smoke detector. The zone transmitters are connected to the AC power lines, 11*a* and 11*b*, by connectors 12*a* and 12*a*', 12*b* and 12*b*' and 12*c* and 12*c*' for zones 10*a*, 10*b* and 10*c*, respectively. This connection to the AC power line will supply the various zone transmitters with operating power as well as conduct the data transmission signals transmitted by or received at each zone.

Also connected to the AC power lines 11*a* and 11*b* are remote controls, two of which are shown in FIG. 1 as 14*a* and 14*b*. These remote controls are designed to trigger other devices within the home, such as turn on specific lights, disconnect phone extensions, etc., and are implemented in a manner to be described below. As shown in FIG. 1, controls 14*a* and 14*b* are connected to the AC power lines 11*a* and 11*b* for operational power and for receipt of transmitted data at connectors 15*a* and 15*a*', and 15*b* and 15*b*', respectively.

Finally, a master receiver 17 is additionally connected to the AC power lines 11*a* and 11*b*. The master receiver 17 is preferably located in an accessible area within the house, such as the master bedroom, and, after detection, displays the information transmitted from the various zones being monitored. For each zone, this information includes an indication of normal operating condition, an alarm condition where one of the trip circuits previously referenced has been triggered, or a malfunction indication in the event that one of the zone transmitters for some reason is not operating properly.

The master receiver 17 will also transmit various control signals to the remote zones, as detailed below, and to the remote controls 14, upon specified conditions. In particular, if an alarm condition is detected from any zone, the master receiver will transmit a special inquiry signal to trigger a verification process of the alarm condition. The master receiver 17 will also transmit a master reset signal to reset all zones within the home for further transmissions after each complete cycle of transmissions from all zones. In the event of an alarm, the master receiver 17 can also be set to transmit signals to the remote controls 14, for example, to turn on lights in a room in the event of an intrusion or fire. Other control functions, as will be described below, may also be added and regulated by the master receiver.

Figure 2:
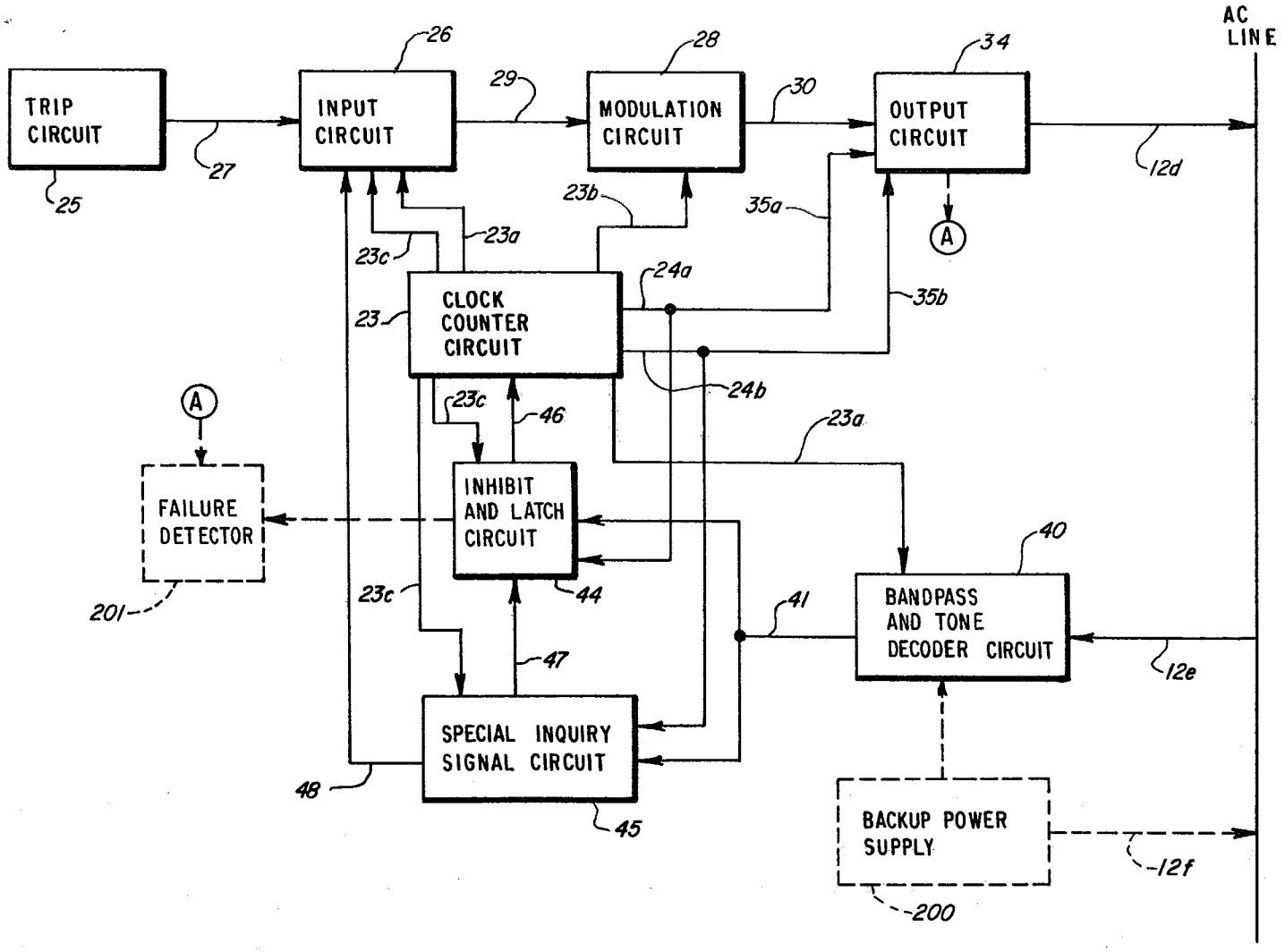
FIG. 2 is a block diagram of one of the zones shown in FIG. 1.

In accordance with the present invention, the protective system as described with reference to FIG. 1 operates utilizing a data transmission pulse comprised of a single carrier frequency. This data pulse signifies an alarm or normal condition and, by a time delay established prior to transmission thereof, the zone location of the alarm or normal condition is identified. Such data transmissions, including establishing the aforementioned time delay prior thereto, are generated within each remote zone. Each remote zone further acts to carry out the verification process in alarm conditions and to synchronize data transmissions with the other remote zones in the system. These functions are described below with reference to FIG. 2, showing a block diagram of the various circuits within each remote zone. The AC line in FIG. 2 is shown generally by reference numeral 11 and connections between the zone circuit and the AC line 11 are represented, in functional form, by arrows 12*d*, 12*e* and 12*f*.

The heart of each remote zone is a clock and counter circuit functionally represented by block 23. The clock and counter circuit 23 contains a crystal oscillator, binary counters and shift registers which, in a manner to be described in detail below, transmit various control clock signals, on lines 23*a*, 23*b*, and 23*c*, to other circuits within each zone transmitter. The counters and shift registers also establish a predetermined time delay ultimately used in data transmission to the master receiver. This time delay is different for each remote zone and thus identifies the specific zone transmitting data at any particular instant of operation of the protective system of the present invention. Outputs 24*a* and 24*b* from the clock and counter circuit transmit start and stop control signals, respectively, for each zone to other circuits within each zone transmitter, the start signal processed after the aforementioned predetermined time delay unique for each particular zone.

Alarm trip circuits which monitor specific areas within the zone, such as windows, doors or smoke detectors within a particular room, are represented in FIG. 2 by numeral 25. The trip circuits 25 are functionally connected to an input circuit 26 as represented by an arrow 27. The function of the input circuit 26 is to detect the state of the trip circuit 25, either alarm or normal, and to either transmit or block a 1200 Hz. control clock signal received from the clock and counter circuit 23 along line 23*a* to a modulation circuit represented by numeral 28. This control clock signal is transmitted along the connection represented by arrow 29 when an alarm state is sensed by the input circuit 26 and is blocked, preventing any transmission along connection 29, when an alarm state is not sensed. The input circuit 26 will additionally store in memory by a latching configuration an alarm condition as established at trip circuits 25. Use of the memory or latching circuit permits operation whereby when an alarm indication is ultimately transmitted to the master receiver, a verification process is initiated checking the memory in input circuit 26 to verify if an actual alarm condition exists or if the alarm transmission sensed by the master receiver was caused by noise or some other error. This verification process will significantly reduce the number of false alarms sensed by the protection system of the present invention and thus also reduce the expense of unnecessary security actions which would have otherwise followed, such as bringing in guards, police or fire department personnel.

The primary function of the modulation circuit 28 is to modulate a 38.4 KHz. signal received from the clock and counter circuit 23 along a connection 23*b* when an alarm condition is detected, or to transmit the 38.4 KHz. control signal unmodulated when an alarm condition is not detected. Specifically, in alarm, the modulation circuit 28 will modulate the 38.4 KHz. signal by the 1200 Hz. signal received through connection 29 and transmit this modulated output through the line functionally represented by arrow 30. With no alarm condition, the 1200 Hz. signal is blocked, as described above, so that no modulation occurs and a stable 38.4 signal is transmitted through line 30.

The modulated or unmodulated signal transmitted through line 30 enters an output circuit represented in FIG. 2 by block 34. The output circuit 34 receives the 38.4 KHz. square wave input from line 30, and receives start and stop control transmissions from outputs 24*a* and 24*b*, respectively, from the clock and counter circuit 23 along lines indicated at 35*a* and 35*b*. The output circuit 34 then converts the square wave signal received through connection 30 to a sine wave, current amplifies this signal, and then, in the time period established by the start and stop transmissions through connections 35*a* and 35*b*, transmits a stable or modulated sine wave data transmission pulse to the AC line 11 via connecton 12*d*; the stable data transmission pulse comprised of the 38.4 KHz. carrier signal and the modulated data transmission comprised of the 38.4 KHz. carrier signal modulated by 1200 Hz.

Each data pulse transmitted, between the aforementioned start and stop transmissions, extends for a duration of 213 milliseconds in the present embodiment. The length of the pulse is thus relatively long for signal transmissions being greater than one cycle of the AC power waveform. The long pulse length is made possible because the data transmissions, although imposed on the AC line, are independent of and not synced to any portion of the AC 60 Hz. waveform, e.g., thereby not forcing an upper limit of one cycle for the duration of a data pulse. Both the extended length of the data pulse and its asyncronous nature with respect to the AC power waveform, plays an important role in presenting a highly reliable system and one that is less susceptible to miscellaneous AC line noise of varying magnitudes and durations.

In addition to the sequence of events in transmitting an alarm or normal data signal, as described above, each zone of the protective system of the present invention also detects all transmissions on the AC line 11. The purpose of this receipt of information by each zone is threefold: (a) to detect transmissions from other zones in order to synchronize its own time delay and transmission by resetting its clock and counter circuit 23, (b) to detect special inquiry pulses from the master receiver 17 so that a verification of an alarm condition can be accomplished, and (c) to detect a master reset signal from the master receiver 17 after all zones have completed their data transmission.

Figure 3A:
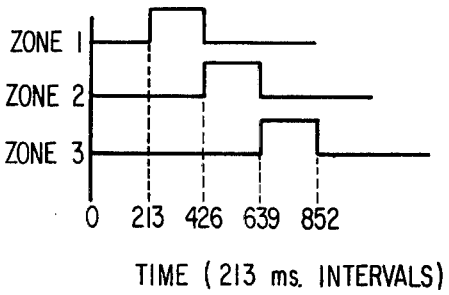
FIGS. 3*a, b* and *c* are a set of graphs useful in explaining the operation of portions of the present invention shown in FIG. 2.
Figure 3B:
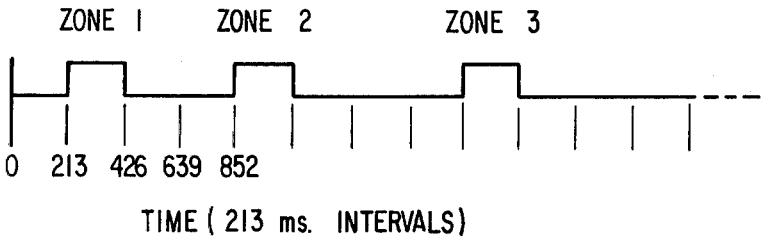

As previously referred to, the unique time delay of each zone prior to transmission of its data pulse identifies the particular zone from other zones throughout the house. A relatively long delay between transmissions of various zones is advantageous in clearly and accurately identifying a particular zone and in further being less suseptible to noise. However, built-in long time delays are expensive when considering component cost and are undesirable when they prevent rapid secondary data transmissions from remote zones to verify alarm conditions upon special inquiry pulses from the master receiver. In providing the desired long time delays yet overcoming the stated disadvantages, each remote zone in the protective system of the present invention which has not transmitted data in a cycle of operation resets and triggers its time delay prior to data transmission by the end of the data transmission from each prior remote zone. For example, zone 1 in the preferred embodiment is present to transmit a 213 millisecond data signal in the second 213 millisecond period within a cycle, zone 2 has a preset delay of two periods and is set to transmit its data pulse after 426 milliseconds, zone 3 is preset to delay three periods and will transmit its 213 millisecond pulse after delaying 639 milliseconds, and so forth up to the maximum of 14 zones. These preset time delays within each zone are demonstrated in the graph of FIG. 3*a* which shows timing of the preset data pulse transmission for the first three zones. However, since after the data transmission of each zone, all succeeding zone clock and counter circuits are reset, the actual time delays are significantly longer and the various data transmissions are more spaced in time. As such, after zone 1 transmits a data pulse, all zones will be reset whereby zone 2 will transmit data two clock periods delayed after the transmission of zone 1. After the transmission from zone 2, all remaining zones are again reset and zone 3, the next zone in the sequence which will transmit data, will send out a signal pulse three clock periods after the pulse from zone 2, and so forth. The synchronized series of data pulses is shown in FIG. 3*b*. In this fashion, relatively long time delays are established between data transmissions, but yet relatively short time delays are preset into each zone. This allows for a great saving in component cost and, in view of the self-syncing/resetting between zones, additional zones can easily be added onto the system without expensive rewiring or expensive installation costs. This procedure, with only short time delays actually preset in each zone, further allows rapid verification of signals upon receipt of special inquiry pulses as will be described below.

Figure 3C:
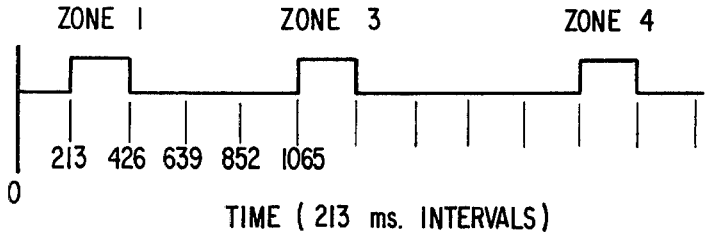

FIG. 3*c* demonstrates the data transmission line received by the master receiver 17 when one of the zones, zone 2 in this example, fails to transmit. As shown, the remainder of the zones continue transmitting and maintain their sequential order. The offset of data pulses from that anticipated (FIG. 3*b*) will show that one zone is malfunctioning, the specific malfunctioning zone being identified in the master receiver by the new transmission line patterns and time duration for transmitting a complete cycle.

As shown in FIG. 2, the detection of signals in each zone functionally begins at arrow 12*e* connected to the AC line 11 which senses and receives any data transmission in the AC line. The signal on AC line 11 and transmitted through connection 12*e* enters a band pass and tone decoder circuit 40 which contains a band pass filter followed by a tone decoder. This circuitry provides logic signal outputs in response to frequency signal inputs on the AC line, and in particular, establishes a low logic level output only when actual data transmission signals are being sensed from AC line 11 as opposed to noise or extraneous signals of different frequencies. The logic signal then produced is ultimately transmitted out of the band pass circuit at output 41 and transmitted to an inhibit and latch circuit 44 and a special inquiry signal circuit 45.

The primary function of the inhibit and latch circuit 44 is to transmit a reset signal to the clock and counter circuit 23 along connector 46. This reset signal functions to reset the time delay of each zone prior to its own data transmission and upon detection, in band pass circuit 40, of data transmissions from other zones, as described above, and also, after an alarm data transmission from each zone, to establish the subsequent transmission of the signal in memory in input circuit 26 for verification of the alarm condition. The inhibit and latch circuit 44 also acts to inhibit a reset signal at connection 46 when the data transmission signal being detected at the band pass circuit 40 is the same signal being transmitted from that particular zone, as established by a "start" signal received from line 24*a*, e.g., the clock and counter circuit 23 of a zone will thus not be reset from the detection of its own transmission.

When an alarm signal is transmitted from a remote zone to the master receiver, the master receiver will, before recycling all zones within the house, transmit a special inquiry signal for verification of the alarm condition detected. This special inquiry signal comprises a series of pulses, the number of which identifies the remote zone being verified. The series of pulses of a special inquiry signal are detected within the special inquiry circuit 45 and compared with a memory contained therein to determine if that circuit is of the zone to which a verification is addressed. If verification is required of that zone, the special inquiry signal circuit 45 will transmit at line 47 a signal to the inhibit and latch circuit 44 so as to reset the clock and counter circuit 23 through reset connection 46 of that particular zone enabling a new transmission of that data signal stored in memory of the input circuit as described above. The special inquiry signal circuit 45 will also transmit, after a transmission of the verification signal, a signal functionally represented by arrow 48 to the input circuit 26 to effectively clear the memory therein and reset the input circuit for future cycles of operation.

As previously described, the master receiver 17 will detect signals transmitted from the various remote zones, display information from such signals, and will transmit control signals to the remote zone 10 and remote controls 14. The master receiver may also be set to activate alarm signals via telephone lines, in the event of an alarm condition, to the police or private security services.

For detection of signal transmissions, the master receiver 17 contains a detection circuit such as that in each zone 10 initiated by a band pass and tone decoder circuit 40. The master receiver then processes the detected signals beginning with a comparison to an ideal or expected pulse train (see, for example, FIG. 3), the processing being accomplished in a well-known manner either by hard-wired circuitry or software using a microprocessor. The processing in the master receiver thus establishes the existence of an alarm, normal or malfunction condition at each zone and then triggers the transmission of a control signal, for verification of alarms, for recycling the zones, to remote controls or for any other action desired. The actual transmission of a control signal is accomplished in the same fashion as the transmission of a signal from each zone, such as by output circuit 34.

Figure 4A:
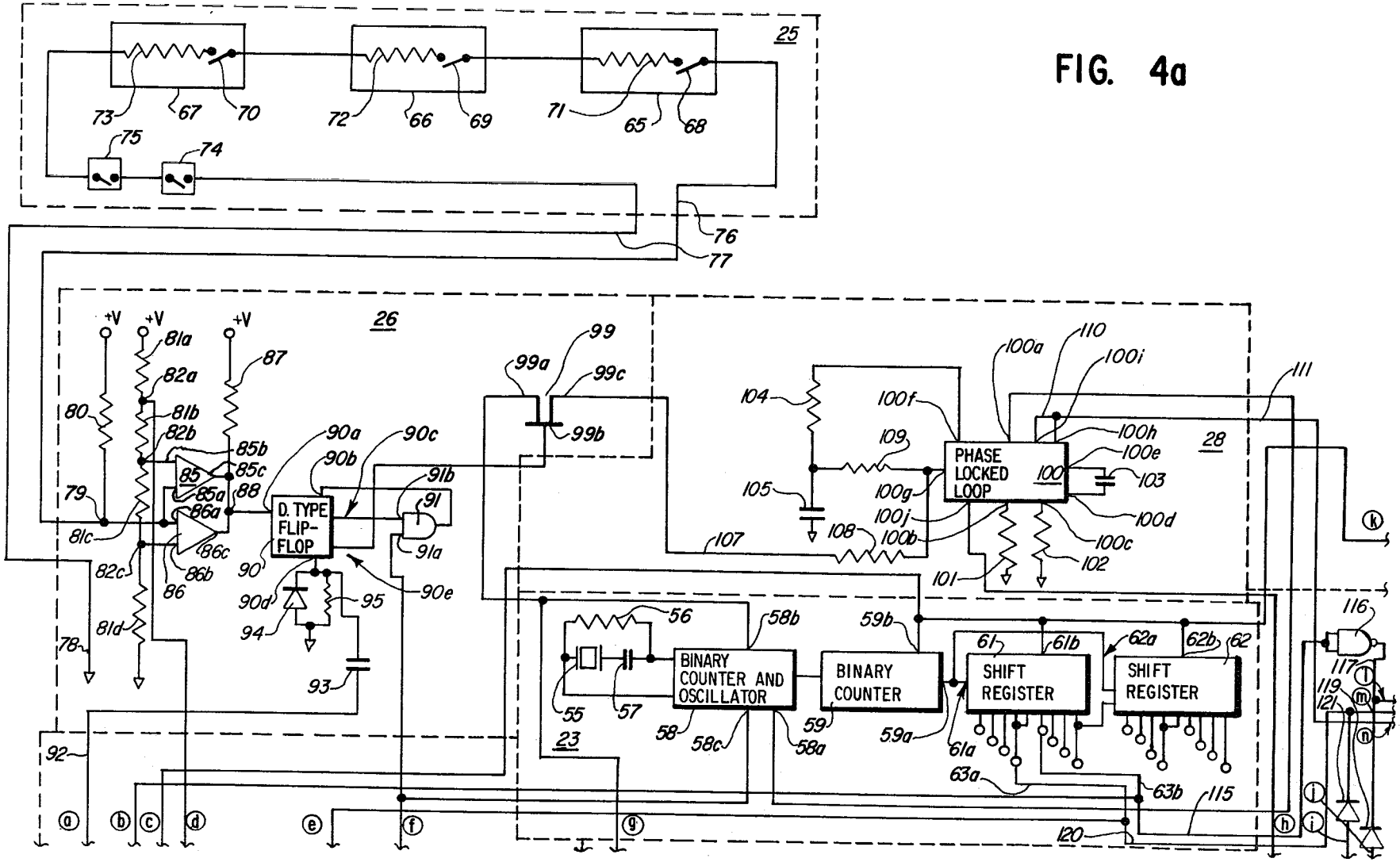
FIG. 4 comprises a schematic diagram of the present invention as shown in block form in FIG. 2.
Figure 4B:
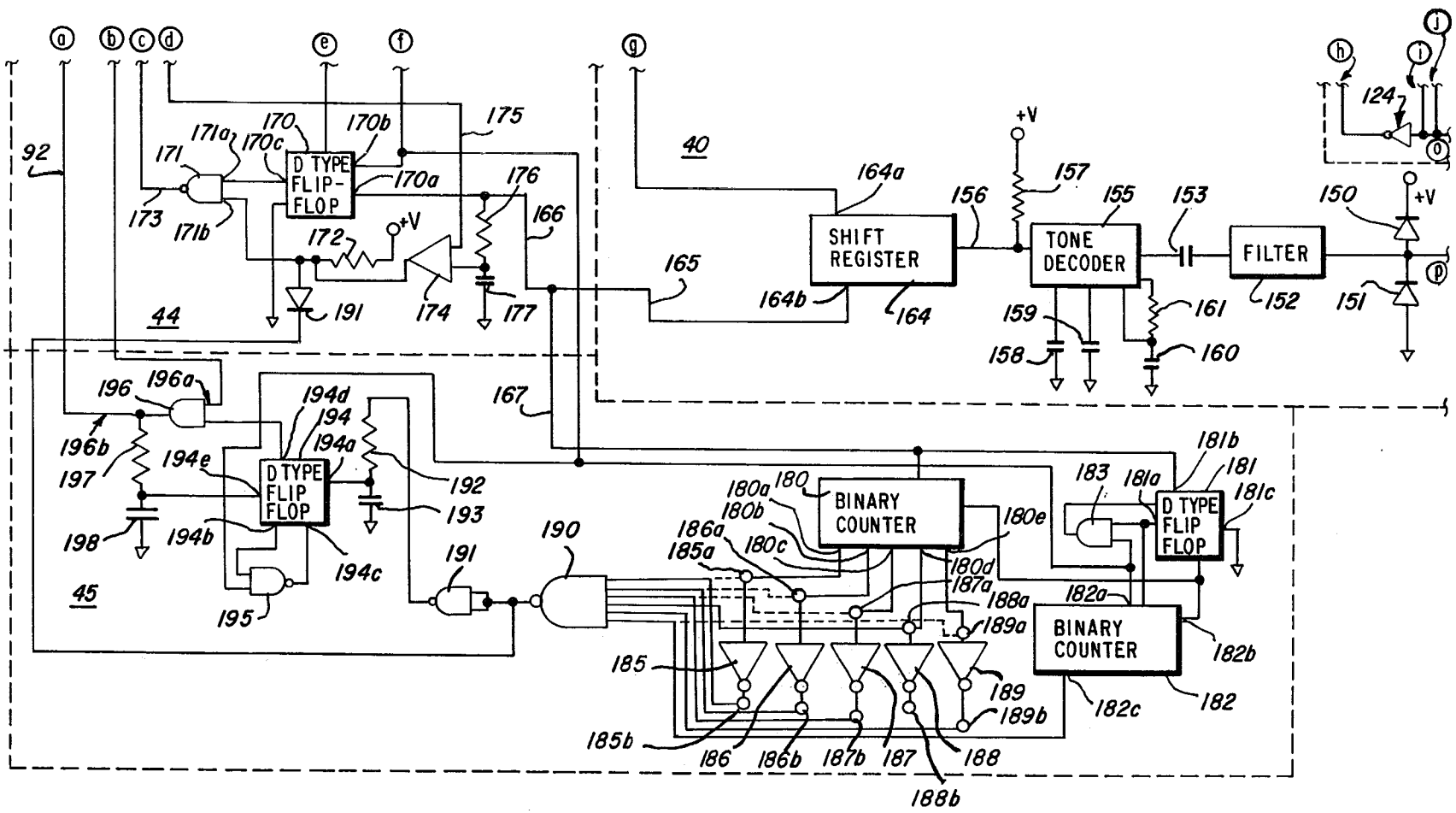
Figure 4C:
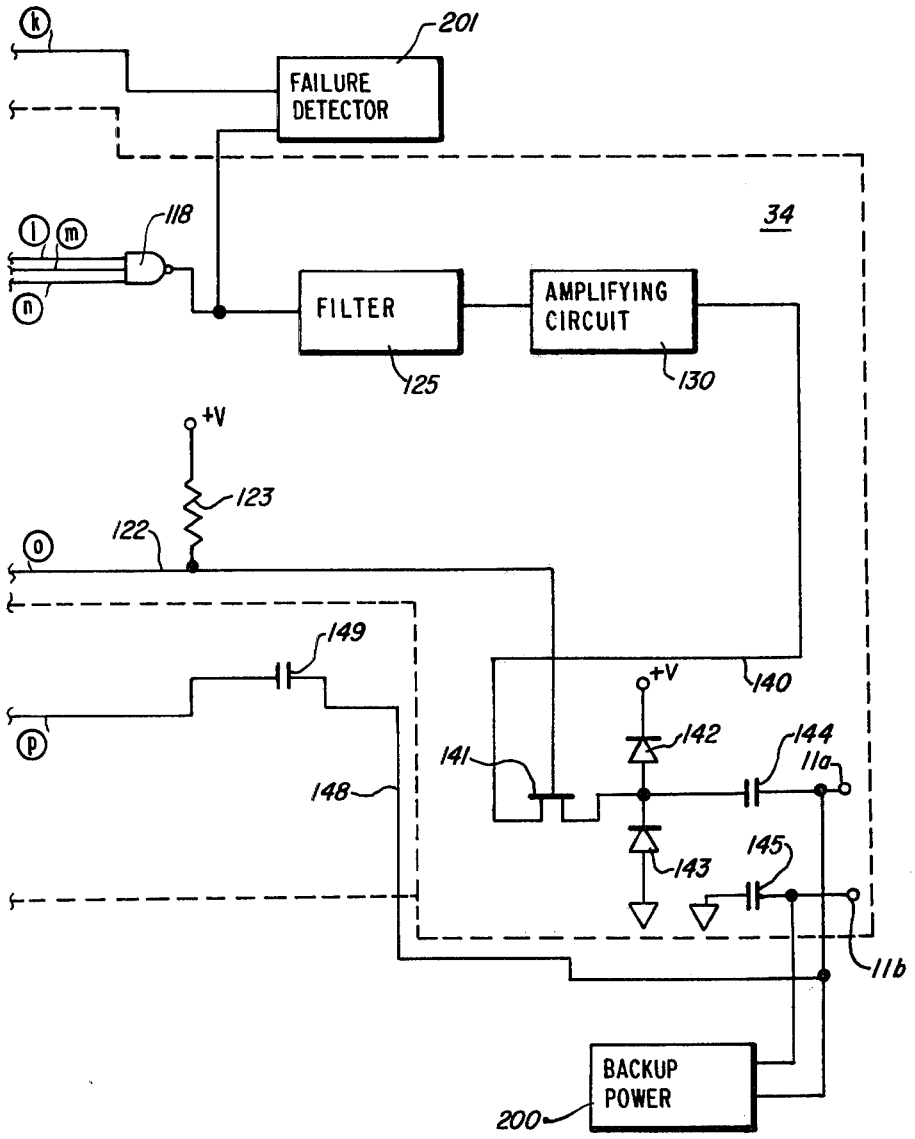

The detailed operation and preferred embodiment of the zone circuitry as thus far described in functional form is set forth in detail in the schematic drawing of FIG. 4. As shown in FIG. 4*a*, the clock and counter circuit 23 is synchronized off a master crystal 55, in the preferred embodiment being 4.9152 megahertz. A timing circuit is formed in a well-known manner by the master crystal 55, resistor 56, capacitor 57 and the oscillator section of a binary counter and oscillator 58. In the preferred embodiment herein, binary counter and oscillator 58 is an RCA COS/MOS 14-stage binary counter/divider and oscillator CD4060 integrated circuit. Binary counter and oscillator 58 is connected to a second binary counter 59 whereby they combine in dividing the 4.9152 megahertz frequency from crystal 55 down by multiples of one half, providing clock outputs used in the present system of 38.4 KHz, 4.8 KHz., 1200 Hz., and 4.68 Hz.; these signals are tapped off outputs 58*a*, 58*c*, 58*b*, and 59*a*, respectively. An RCA COS/-MOS 14-stage binary counter/divider CD4020 integrated circuit may be used for counter 59. The binary counters 59, 61 and 62 are reset and triggered, in a manner to be described in detail below, at reset input 59*b*, 61*b* and 62*b* respectively.

The 4.68 Hz. clock output of binary counter 59 is connected to the clock inputs 61*a* and 62*a* of static shift registers 61 and 62. Shift registers 61 and 62, each being an 8 bit shift register, combine to provide a maximum of 16 counts. These counts give each remote zone in the protective system of the present invention its characteristic time delay before transmission and establish start and stop commands for each zone. For example, zone 4 is preset to start its data transmission at the beginning of the fourth 4.68 Hz. (213 millisecond) clock cycle and stop its data transmission at the beginning of the fifth 4.68 Hz. 213 (millisecond) clock cycle. To accomplish this result, the start command for the fourth zone, as shown in FIG. 4*a*, is provided at a junction 63*a* connected to the fourth output of the combination of shift registers 61 and 62 and the stop command is provided at a junction 63*b*, connected to the fifth output of the shift register combination. The shift registers are reset to the "zero" count condition whenever a reset input at 61*b* and 62*b* is at a logic high state. Standard filtering can be accomplished by inserting a capacitor (not shown) across the ground and power connections to binary counters 58 and 59 and shift registers 61 and 62 for suppressing noise.

The trip circuit 25 of each remote zone comprises several switch and resistor packages such as packages 65, 66 and 67, the packages containing switches 68, 69 and 70 with resistors 71, 72 and 73, respectively. The switches 68, 69 and 70 can be standard reed switches, magnetic switches or the like and are triggered by opening windows or doors to which packages 65, 66 and 67 are connected. Resistors 71, 72 and 73, acting in series, total a reference resistance connected to the open part of a bridge circuit within input circuit 26 thereby providing a monitored resistance level. In this manner, an intruder cannot merely jumper the connections to any of the packages 65, 66 or 67 in an attempt to circumvent the effect thereof. Auxillary switches 74 and 75 may be added to the trip circuit 25 of any remote zone, without any monitored resistance effect, where intruder jumpering is not of concern, such as for fire and smoke detectors.

Output lines 76 and 77 from trip circuit 25 are connected to the input circuit 26 as functionally represented and previously explained by arrow 27 of FIG. 2. Line 77 is grounded at connection 78, and line 76 leads to junction 79 of the open part of a bridge circuit further comprised by resistor 80. The opposite end of resistor 80 is connected to plus power, as shown in FIG. 4*a*. Resistors 81*a*, 81*b*, 81*c* and 81*d* are connected in series between plus power and ground and provide reference voltages at junctions 82*a*, 82*b* and 82*c*, the reference voltages in the preferred embodiment herein being 7.5 volts, 6.8 volts and 5.2 volts respectively. In order to sense an alarm or normal condition through output lines 76 and 77 of trip circuit 25 there are provided two operational amplifiers 85 and 86 tied together with open collector outputs, said outputs further connected to resistor 87 as a common pull-up resistor. Inputs 85*a* and 86*a* of operational amplifiers 85 and 86, respectively, are tied together and connected to junction 79 of the aforementioned bridge network. Inputs 85*b* and 86*b* receive reference voltages from junctions 82*b* and 82*c*, respectively. In this fashion, if an intruder attempts to jumper one of the packages 65, 66 or 67, for example, this action will upset the input bridge circuit at junction 79 lowering the input voltage at input 86*a* beneath the reference voltage at input 86*b* and causing the output of operational amplifier 86 to go to a logic low state. In similar fashion, if one of the switches 68, 69, 70, 74 or 75 of trip circuit 25 is open, caused by unauthorized opening of windows or doors or a fire or smoke condition, this will also upset the input bridge circuit at junction 79 causing the voltage at input 85*a* to increase above the reference voltage at input 85*b* thereby causing the output operational amplifier 85 to go low. As such, either an open loop condition or a tampering alarm condition will cause junction 88 to go low whereas without an alarm condition, junction 88 will be high being connected to pull-up resistor 87, the other end thereof connected to plus power.

Junction 88 is also connected to the data input, 90*a* of a standard latchable integrated circuit chip 90, such as an RCA 'D'-type flip-flop, No. CD4013. The purpose of latch 90 is to detect an alarm or normal condition, by a logic low or high at its input 90*a*, and upon detection of an alarm, to latch in or store this signal (e.g., while any of the trip switches such as 65, 66 or 67 may be reestablished) in an effective memory for further transmission upon a verification request. Specifically, the clock input of latch 90, at 90*b*, is connected to the output of a two input AND gate 91. One input of gate 91, at 91*a*, is connected to output 58*c* of binary counter 58 and receives a 4.8 KHz. control clock signal. The second input, 91*b*, of AND gate 91, is connected to the Q output 90*c* of latch 90. In this fashion, when a normal condition exists so that input 90*a* of latch 90 is high, the Q output at 90*c* is also high allowing the 4.8 KHz. clock pulse to enter input 90*b* of latch 90 through AND gate 91 for continued operation of latch 90. If an alarm state is detected, however, input 90*a* of latch 90 will be pulled low, as described above, causing the Q output at 90*c* also to go low, thus inhibiting the 4.8 KHz. clock at input 90*b* by being blocked at AND gate 91. Latch 90 will be reset and resample the input conditions only when a pulse is detected, upon conditions to be described below, from a line 92 and through the circuit comprising capacitor 93, diode 94 and resistor 95 which, together, are connected to the set input, 90*d*, of latch 90.

As previously described, one of the functions of the input circuit 26, after detecting the state of the trip circuits 25, is to either transmit or block a 1200 Hz. control clock signal to the modulation circuit 28, the 1200 Hz. signal being transmitted during an alarm condition and being blocked during a normal condition. The 1200 Hz. signal is received from output 58*b* of binary counter 58 and is connected to the source input, 99*a*, of a field effect transistor (FET) 99.

The gate of FET 99, at 99*b* is connected to the $\overline{Q}$ output, 90*e*, of latch 90. As such FET 99 will transmit the 1200 Hz. signal received at the drain input 99*a*, through the source output 99*c* only when $\overline{Q}$ at 90*e* of latch 90 is in a logic high state, this being only in an alarm condition. At this time, the source output 99*c* of FET 99 will transmit the 1200 Hz. clock signal to the modulation circuit 28 as functionally represented by arrow 29 of FIG. 2 as previously described.

The modulation circuit 28 receives the primary frequency signal for ultimate data transmission from a remote zone, being 38.4 KHz. in the preferred embodiment, at the signal input, 100*a*, of a Phase Lock Loop (PLL) integrated circuit, 100, similar to the RCA 4046 CMOS PLL. The phase lock loop 100 is internally made up of a voltage control oscillator (VCO) circuit and a comparitor circuit. The aforementioned 38.4 KHz. primary frequency is received from output 58*a* of binary counter 58. The internal VCO frequency is established in a well-known manner by resistors 101 and 102 connected to VCO inputs 100*b* and 100*c*, respectively, and capacitor 103 connected between VCO inputs 100*d* and 100*e*. This internally free running frequency of the VCO is established at 38.4 KHZ., in the present embodiment, identical to the signal in frequency at input 100*a*. The closed feedback loop between the VCO section of PLL 100 and the phase comparitor section of PLL 100 is accomplished with a standard phase-locked loop low pass feedback circuit comprising, in part, a resistor 104 and a capacitor 105, connected to the phase comparitor output 100*f* of PLL 100.

As previously described, a 1200 Hz. signal is transmitted at output 99*c* of FET 99 from the input circuit 26 in the event of an alarm condition. This signal is transmitted via a line 107, corresponding to arrow 29 as shown in FIG. 2, through a summing junction, comprised of resistors 108 and 109, into the VCO control input 100*g* of PLL 100. The summing junction of resistors 108 and 109 regulates the comparative strengths of the 1200 Hz. alarm signal and the phase-locked loop feedback signal into the VCO input at 100*g*. The alarm transmission will cause the output of the VCO at 100*h*, being tied to the comparator in input at 100*i*, to be modulated at 1200 Hz. If an alarm condition is not detected at the input circuit 26, no 1200 Hz. signal will be present at line 107 or VCO input 100*g* and the VCO output at 100*h* will comprise a stable, unmodulated 38.4 KHz. signal. The stable or modulated output from the PLL 100, representing a normal or alarm condition, respectively, is transmitted through a line 111, comparable to arrow 30 as shown in FIG. 2, to the output circuit 34.

In order to conserve power and to extend the reliability of the Phase Lock Loop 100, the PLL 100 will be enabled at its inhibit input 100*j* and thus operational, only during the transmission period of the specific zone of the present invention. During non-transmission periods, a logic low signal is received at the inhibit input 100*j* of PLL 100 thereby turning off this integrated circuit.

The output circuit 34 of each zone receives the modulated or stable transmission via line 111 from the modulation circuit 28, and transmission start and stop signals for that zone from outputs 63*a* and 63*b* respectively of the shift registers 61 or 62. The stop signal from output 63*b* is carried along line 115 which is connected to both inputs of a 2 input NAND gate 116, the output of which is carried along line 117. As such, when a stop signal is received from output 63*b*, being a logic high state, line 117 will be at a logic low state. Line 117 is connected to one input of a 3 input NAND gate 118 and also to the cathode of a diode 119. The transmission on signal from output 63*a* is transmitted through a line 120 to a second input of the NAND gate 118 and also to the cathode of a diode 121. The anodes of diodes 119 and 121 are connected to a line 122 which is also connected to plus power through a pull-up resistor 123. In this manner, diodes 119 and 121 and resistor 123 form an "OR" function so that line 122 will be pulled to a logic high state, via resistor 123, only during the specified data transmission of the particular zone when lines 117 and 120 are both high, thereby reverse biasing diodes 119 and 121. When line 120 or line 117 is low, during a non-transmission period, diodes 119 and 121 are forward biased pulling line 122 to a logic low state. Line 122 is additionally connected to the input of an inverter 124, the output of which is connected to the inhibit input 100*j* of PLL 100. In this manner, the PLL 100 will be inhibited or enabled during nontransmission or transmission periods, respectively, as noted above.

The remaining input of NAND gate 118 is from line 111, containing the modulated or stable 38.4 KHz. transmission signal for an alarm or normal condition. As such, the output of NAND gate 118 will transmit the modulated or stable signal from line 111 only during the specific transmission period for the particular zone in view of the start and stop signals received from outputs 63*a* and 63*b*, respectively, from binary shift registers 61 or 62.

The output of NAND gate 118 is connected to an active band pass filter 125 so that only the fundamental transmission frequencies remain, the transmission signal also being converted from a square wave signal to a sine wave transmission. Active band filters, such as unit 125, as well-known in the art and need not be described in any further detail.

The output of the filter 125 is connected to a push-pull amplifying circuit 130 which increases the current drive of the transmission signal being established from the present zone. The transmission signal is then forwarded along a line 140 to the source input of an FET 141. FET 141 is triggered from line 122, connected to the gate thereof, and is therefore enabled, passing the signal from line 140, only during the particular transmission periods of the particular zone of the present invention. The source output from FET 141 is connected to the anode of a diode 142 and the cathode of a diode 143, diodes 142 and 143 providing clamp protection to the FET 141. The cathode of diode 142 is connected to plus power and the anode of diode 143 connected to Ground. In this manner, the source output of FET 141 is prevented from going more than 0.7 volts above plus power or below Ground. This latter signal is then connected through coupling capacitor 144 to the AC line 11*a*. The other AC line, 11*b*, is similarly connected through a coupling capacitor 145.

To the extent already described with reference to the schematic drawing of FIG. 4, there has been disclosed the partial electronic circuit of one of the zones of the present protective system, this partial circuit acting to detect an alarm or normal condition and transmit a modulated or stable data signal, depending upon this condition, over the AC lines 11*a* and 11*b*. In addition to transmitting a data signal during a particular time period, the electronic circuit of each zone will also detect transmissions from all other zones and from the master receiver as also transmitted along AC lines 11*a* and 11*b*. This latter detector circuitry initiates with a line 148 connected to AC line 11*a*, leading to the band pass circuit 40 as was functionally represented and described with reference to connection 12*e* in FIG. 2.

Line 148 is connected to coupling capacitor 149 which acts as a low impedance pass for the 38.4 KHz. data signal frequency and simultaneously acts as a high impedance block for the 60 cycle line voltage, effectively attenuating this latter signal. A typical value for capacitor 149 in the preferred embodiment is 400 volts, 0.01 microfarads. The other end of capacitor 149 is connected to the anode of a diode 150 and cathode of diode 151, diodes 150 and 151 functioning as clamp protection diodes preventing the signal eminating from capacitor 149 from going more than 0.7 volts above plus power or below Ground. The cathode of diode 150 is connected to plus power and the anode of diode 151 is connected to Ground.

The primary frequency being detected from the AC line after passage through capacitor 149 and through the clamp protective diodes 150 and 151 then enters an active band pass filter 152. This filter, similar to active band pass filter 125, will only allow the fundamental transmission frequencies to remain, the details of such filters being well-known in the art. The output of filter 152 is connected to a coupling capacitor 153, the other end of which is connected to the input of a tone decoder integrated circuit chip 155.

Tone decoder 155 is a standard integrated circuit mechanism, such as an NATIONAL 567 integrated circuit chip, and upon detection of a proper signal frequency and phasing, the output thereof at line 156 is established at a logic low level. When a proper signal frequency and phasing is not detected, line 156 will be pulled to a logic high state through pull-up resistor 157 connected thereto, the other end of resistor 157 being connected to plus power. Establishing the frequency and phase pattern for detection of tone decoder 155, in a standard and well-known fashion, is an output filter capacitor 158, a loop filter capacitor 159, a timing capacitor 160 and a timing resistor 161 connected to the various tone decoder inputs as shown in FIG. 4*b*. For further details with regard to such connections, one can refer, for example, to the specification sheets published by the various integrated circuit manufacturers, such as in NATIONALS Linear Integrated Integrated Circuits Data Book.

The output of tone decoder 155 is connected, through line 156, to the input of a static shift register 164. Shift register 164 establishes a time delay of sufficient duration in the signal from tone decoder 155 to provide a clean, accurate transmission and eliminate false triggering due to short line transmits which might contain a 38.4 KHz. component. This delay, in establishing signal conditioning, is also long enough to miss any short term noise and allows triggering action only after any signal bounce has dissipated. In this fashion, the protective system of the present invention takes advantage and makes use of its relatively long duration transmission signal eliminating noise problems and false triggering inherent in systems with a short transmission signal.

A clock input 164*a* to the shift register 164, is connected to output 58*b* of binary counter 58 and provides a 1200 Hz. clock input. In this manner, at each clock input, there will be a logic high level output at output 164*b* of register 164 when the input from line 156 is low and a logic low output at 164*b* when the input from line 156 is high. The signal from output 164*b* is transmitted along line 165, this signal being high when a signal transmission is being detected over the AC lines originating from one of the zone transmitters or from the master receiver and will be a logic low level when no signal is being detected. Line 165 is comparable to connection 41 shown in FIG. 2 and is directed to the inhibit and latch circuit 44 along line 166 and is directed to the special inquiry signal circuit 45 along line 167.

The binary counters 58 and 59 and shift registers 61 and 62 of each zone circuit will be reset for data transmission from each particular zone under three conditions: (a) upon the detection of a transmission from another zone, (b) upon detection of a master reset signal from the master receiver, e.g., after all zones have transmitted in one system cycle, and (c) upon detection of a unique inquiry pulse train from the master receiver for verification of an alarm signal. The inhibit and latch circuit 44 has the function of resetting the binary counters 58 and 59 and the shift registers 61 and 62. This circuit will detect transmissions from other zones to reset the counters and shift registers, while disabling any reset signal during transmission of its own zone; will detect a master reset signal from the master receiver for resetting the counters and shift registers; and will also be triggered from the special inquiry circuit 45, in a manner to be described below, to reset the counters and shift registers upon a unique inquiry pulse for verification of an alarm condition.

When a proper signal is detected and a logic high is transmitted through line 166 as described above, this signal is entered into the data input, 170*a*, of a latchable integrated circuit chip 170 comprising a 'D'-type flip-flop. This detected signal is allowed normally to be clocked to the output of latch 170 which has connected to its clock input, 170*b*, the 4800 Hz. clock pulse originating at output 58*c* of the binary counter 58. As such, the $\overline{Q}$ output, 170*c*, is normally high and goes low for the duration of the detected input signal. In order to prevent eventual resetting of the binary counters 58 and 59 and shift registers 61 and 62 when a signal is detected originating from any zone's own transmission, the reset input to latch 170 is connected to the zone's "transmission on" signal from output 63*a*. This high logic state from output 63*a* when the zone itself is transmitting disables the latch 170 and forces the $\overline{Q}$ output to stay high regardless of what signal is being received at the data in or clock inputs. In effect, latch 170 is, in this manner, latched into a nonresponsive state.

The output $\overline{Q}$ from latch 170 is connected to input 171*a* of a 2 input NAND gate 171. The other input to NAND gate 171, 171*b*, is normally high being connected to plus power through a pull-up resistor 172. As such, when the $\overline{Q}$ output of latch 170 is low, being for the duration of a detected input signal other than that signal from its own zone, the output of NAND gate 171 will be high. This latter output is connected through line 173, functionally represented by arrow 46 in FIG. 2, to the reset inputs of binary counter 59 and shift registers 61 and 62.

As previously described, after all of the zones have transmitted their respective signals, the master receiver will transmit a master reset signal to recycle all zones. This master reset signal is of a substantially longer duration than the transmission signals from each zone, in the preferred embodiment being 639 milliseconds compared to a normal transmission duration of 213 milliseconds. In order to reset the various zones upon detection of a master reset signal, there is provided an operational amplifier 174, the plus input thereof connected via line 175 to a reference voltage at junction 82*a* and the negative input connected to the junction between a resistor 176 and a capacitor 177. The other end of resistor 176 is connected to line 166, transmitting a high logic state when a signal is being detected along AC lines 11*a* and 11*b*, and the other end of capacitor 177 is connected to ground. In the preferred embodiment of the present invention, resistor 176 has a value of 210 K ohms and capacitor 177 has a value of 2.2 microfarads, whereby it will take capacitor 177 approximately 470 milliseconds to charge up to the referenced voltage at the plus input of the operational amplifier. The output of operational amplifier 174 will thus remain high for any detected signal less than 470 milliseconds, which includes all normal transmission signals, and will be pulled low for longer transmission signals, such as the master reset signal. The output of operational amplifier 174 is connected to input 171*b* of NAND gate 171 and will establish a high logic level signal at line 173 at the end of a master reset signal resetting binary counter 59 and shift registers 61 and 62.

Binary counter 59 and shift registers 61 and 62 can also be reset for further transmission of a particular zone upon detection of the special inquiry signal referenced above for verification of alarm conditions. This operation is triggered within the special inquiry signal circuit 45. Specifically, the special inquiry signal transmission, established by the master receiver, 17, upon detection of an alarm condition, comprises a series of short pulses, one pulse for each particular zone plus a fixed offset of four pluses. This fixed offset, providing an inherent time delay, is established in order to prevent normal transmission signals from being acknowledged by the special inquiry signal circuit 45. Thus, for example, in the event of an alarm condition signal received at the master receiver from Zone 4, a verification signal of eight short pulses will be transmitted back along the AC line 11 to each zone.

The special inquiry pulse signal is transmitted through to line 165, as with other detected signals noted above, and enters the special inquiry signal circuit 45 through line 167. This data is input to a 7-stage binary counter 180, which operates to count the specific pulses received during a set "window" time period, and to a latch integrated circuit 181, comprising a 'D'-type flip-flop.

The $\overline{Q}$ output of latch 181, at 181*a*, is connected to the reset input of a 14-stage binary/ripple counter, 182 (such as an RCA CD4020 digital integrated circuit), which functions to control the duration of the aforementioned "window" time period by counting clock pulses at its input 182*a* connected to output 58*c* of binary counter 58. In the preferred embodiment of the present invention, output 182*b* of counter 182 will go to a logic high level 1.7 seconds after being reset by latch 181 as described above. After this "window" time period, the signal at 182*b* will reset latch 181 and counter 180, output 182*b* connected to the reset inputs of these latter two devices.

Latch 181 has its clock input at 181*b* connected to the output of a two-input AND gate 183, one input thereof connected to the $\overline{Q}$ output, 181*a*, of latch 181 and the other connected to the 4800 Hz. clock output 58*c* of binary counter 58. The set input, 181*c* of latch 181 is connected directly to Ground as shown in FIG. 4. In this manner, the leading edge of the first detected special inquiry signal will cause latch 181 to "lock" in. The $\overline{Q}$ output then goes to a logic low level inhibiting the clock signal from going through AND gate 183 into the clock input of latch 181. Latch 181 will be reset only when the circuit 45 completes the intended comparison of special inquiry pulses counted by counter 180 against a preprogrammed number for each zone, to determine if the special inquiry signal is requesting verification from that zone. The time period for this comparison is established by the aforementioned "window."

The preprogrammed number for each zone is established by a series of five inverters, 185, 186, 187, 188 and 189 representing the successive digits of a binary number starting with inverter 185 representing the units column, 186 representing the 2's column, and so forth. This preprogrammed number is compared to the output of counter 180 at an expanded 6-input NAND gate 190 so that all inputs thereof will be high when, at the end of a set time period, the special inquiry signal matches the preprogrammed number in the partial zone requiring verification of an alarm condition. For example, in the fourth zone, the preprogrammed number necessary to detect a special inquiry signal for verification is 8, or 01000 in binary, following the formula for each zone as noted above. In that zone, if eight special inquiry pulses are detected, the outputs 180*a*, 180*b*, 180*c*, 180*d* and 180*e* of counter 180 will transmit logic level signals of 0, 0, 0, 1, 0, respectively. The first five inputs of NAND gate 190 in the fourth zone are connected to the $\overline{Q}$ outputs 185*b*, 186*b*, 187*b*, the Q output 188*a*, and the $\overline{Q}$ output 189*b* or inverters 185 through 189, respectively, as shown in FIG. 4. Thus, upon detection of eight special inquiry pulses, the first five inputs of NAND gate 190 will each be high only in the fourth zone. The sixth input of gate 190 will go high after a sufficient time period established at output 182*c* of counter 182, being 854 milliseconds in the preferred embodiment of the present invention. When all inputs of gate 190 are high, the output thereof goes to a logic low state and, being connected to input 171*b* of NAND gate 171 through a blocking diode 191, this logic low signal will create a logic high signal at line 173 thereby resetting binary counter 59 and shift registers 61 and 62. Once counter 59 and registers 61 aND 62 are reset, that particular zone will be able to retransmit a data signal in order to verify an alarm condition.

Within the Special Inquiry Signal circuit 45 there is also provided a latch circuit to generate a resample pulse on line 92, corresponding to arrow 48 in FIG. 2, for resetting latch 90 clearing the memory in input circuit 26 in preparation of further cycles of operation. The output of NAND gate 190, which is at a logic low level upon detection of a verification request, is also connected to both inputs of a two input NAND gate 191 which thus functions as an inverter. The output of gate 191 is connected through an RC network, comprising resistor 192 and capacitor 193, to the data input 194*a* of a latching chip 194 comprising a flip-flop such as an RCA CD4013 integrated circuit. The $\overline{Q}$ output, 194*b*, of latch 194 is connected to one input of a two-input NAND gate 195, the other input thereof connected to the 4800 Hz. clock output 58*c* of binary counter 58. The output of NAND gate 195 is connected to the clock input of latch 194 at 194*c*. In this manner, if the signal at input 194*a* reaches the required logic high level, circuit 194 will latch due to the $\overline{Q}$ output at 194*b* going low and inhibiting the clock pulses through NAND gate 195. This action causes the Q output 194*d* to go to a high logic level.

The Q output 194*d* of latch 194 is connected to one input of a two-input AND gate 196, the other input thereof being connected to the transmission stop signal at output 63*b* of Shift register 62. Thus, when a zone has completed its alarm verification transmission satisfying the special inquiry request (and a logic high pulse thus being received from the stop signal output at 63*b*), the output of AND gate 196 will go high establishing a pulse on line 92 which resets latch 90 clearing the memory in input circuit 26 and allowing for further sampling of the alarm trip circuit 25.

To prevent a premature logic high transition of AND gate output 196*b*, the RC network of resistor 192 and capacitor 193 provides the necessary delay so that the counter/divider circuitry within circuit 23 will reset before input 194*a* reaches a logic high level. The pulse at line 92 also acts to reset latch 194, at reset input 194*e*, until another special inquiry pulse train is recognized. However, in order to assure that the special inquiry signal circuit 45 (latch 194) is reset after the input circuit memory (latch 90) a delay is established prior to a reset signal being received at input 194*e* by the RC network of resistor 197 and capacitor 198, connected between the output of AND gate 196 and input 194*e*.

While the above has described the major aspects of the present invention, further safety and failsafe circuits can easily be added thereto. For example, a backup power supply, 200, as shown in FIG. 2 and in FIG. 4, can be connected to the AC line 11 for use in the event of a power failure in the house. This power supply will provide the necessary power to the various components of the present invention as well as provide the transmission power required to couple the 38.4 KHz. data signal carrier onto the now static AC power line.

An additional safety factor may be added by a failure detector circuit 201 which is intended to blow a fuse or otherwise shut down a particular zone which might fail in a constant transmission mode. Such a failure would jam communications between other zones and the master receiver and set off false alarms. This failure detector circuit can be set up, in well-known digital components, to trigger a shut down sequence when there occurs a specific set of simultaneous logic levels created by the failure mode stated above. Such "sense" points would be from the output of NAND gate 118, and from the output of NAND gate 171. Both points will go high if and only if a zone fails in the above stated mode.

While there has been shown and described a particular embodiment of the present invention, it will be apparent to those skilled in the art that various modifications may be made without departing from the invention in its broader aspects and it is therefore aimed in the appended claims to cover all such changes and modifications as fall within the true spirit and scope of the present invention.

What is claimed as new and desired to be secured by Letters Patent of the United States is:

1. A protective system having at least two remote stations and a master receiver all connected by a common AC power line, said protective system comprising:

(a) at least one monitoring means connected to each remote station for detecting an alarm or normal condition at said monitoring means;

(b) timing means;

(c) signal generating means within each remote station responsive to said monitoring means and said timing means for producing and transmitting on said AC power line alarm and normal data transmission signals representing alarm or normal conditions;

(d) each of said alarm and normal data transmission signals comprising a data pulse of greater duration than one cycle of the AC power wave form wherein said data pulse is not synced to or dependent upon said AC power wave form;

(e) said signal generating means transmitting said data pulse after a time delay established by said timing means unique for each remote station;

(f) transmission sensing means within said master receiver for detecting alarm or normal data transmission from each remote station;

(g) control signal generating means within said master receiver responsive to said master signal sensing means for producing control data transmission signals; and (h) signal sensing means within each remote station responsive to data transmissions from each remote station and from said master receiver.

2. A protective system as in claim 1 wherein each normal data transmission signal comprises a single carrier frequency data pulse and each alarm data transmission signal comprises a modulated single carrier frequency data pulse, said single carrier frequency of the normal data transmission signal being equal to said single carrier frequency of the alarm data transmission signal.

3. A protective system as in claim 1 wherein said transmission sensing means further detects for the absence of an alarm or normal data transmission signal from each remote station.

4. A protective system as in claim 1 wherein each remote station transmits at least one data pulse during a complete cycle of operation, the data pulse from each remote station being transmitted in a different time period than the datea pulse from each other remote station.

5. A protective system as in claim 4 including memory means within said signal generating means for storage of data of an alarm condition when detected at said monitoring means for use in producing and transmitting a second alarm data transmission signal within said cycle of operation for verification of said alarm condition.

6. A protective system as in claim 5 wherein said control data transmission signals includes a verification signal transmitted from said master receiver upon detection by said transmission sensing means of an alarm data transmission signal.

7. A protective system as in claim 6 wherein said verification signal comprises a digitally coded pulse train, said digitally coded pulse train identifying the remote station transmitting an alarm data transmission signal detected by said transmission sensing means.

8. A protective system as in claim 7 including verification signal detecting means within said signal sensing means for encoding said digitally coded pulse train and being operable to reset said timing means for transmission of a second data transmission only from the identified remote station.

9. A protective system as in claim 5 wherein said control data transmission signals include a master reset signal transmitted from said master receiver upon detection by said transmission sensing means of all data transmissions from all remote stations indicating completion of one cycle of operation.

10. A protective system as in claim 1 wherein said monitoring means includes at least one switching means and said signal generating means includes means to detect a change in status of said switching means, the change in status representing an alarm condition.

11. A protective system as in claim 10 wherein said monitoring means further comprises at least one resistive means connected to said at least one switching means establishing a known impedance of said monitoring means and said signal generating means further including means to detect a change in impedance of said known impedance, the change of impedance representing an alarm condition.

12. A protective system as in claim 4 wherein said timing means is contained within each remote station.

13. A protective system as in claim 12 wherein said timing means, within each remote station which has not transmitted data during a cycle of operation, is reset thereby also resetting said unique time delay for each remote station upon detection by said signal sensing means within each remote station of a data transmission signal from each other remote station.

14. A protective system as in claim 13 including inhibit means within each remote station to prevent resetting of said timing means upon detection by said signal sensing means within each remote station of that remote station's own data transmission signal.

15. A method of operating a remote station in a protective system receiver all connected by a common AC power line, comprising the steps of:

(a) monitoring resistance levels at alarm detection stations connected to each remote station;

(b) producing a single carrier frequency signal within each remote station;

(c) detecting a change or no change in said resistance levels, a change in resistance level indicating an alarm condition and no change in resistance level indicating a normal condition; and (d) transmitting a data pulse of duration greater than one cycle of said AC power waveform after a time delay unique for and identifying each remote station wherein said data pulse comprises said single carrier frequency under a normal condition and comprises said single carrier frequency modulated under an alarm condition.

16. A method as in claim 15 wherein the operation of each remote station further comprises the steps of:

(a) detecting transmission signals present on the AC power waveform originating from each remote station and from the master receiver; and (b) resetting said time delay prior to transmitting said data pulse within a cycle of operation upon detection of a data pulse from each other remote station.

17. A method as in claim 16 wherein the operation of each remote station further comprises the steps of:

(a) resetting said time delay after transmitting said data pulse within a cycle of operation upon detection of a special inquiry pulse from said master receiver;

(b) transmitting a second data pulse for verification of a prior data pulse transmitted within the same cycle of operation after said time delay has been reset upon detection of said special inquiry pulse; and (c) resetting said time delay after transmitting said data pulse within a cycle of operation upon detection of a master reset signal from said master receiver.

18. A remote station for use in a protective system having at least two such remote stations and a master receiver all connected by a common AC power line, said remote station comprising:

(a) at least one monitoring means for detecting an alarm or normal condition at said monitoring means;

(b) timing means;

(c) signal generating means responsive to said monitoring means and said timing means for producing and transmitting on said AC power line alarm and normal data transmission signals representing alarm or normal conditions;

(d) each of said alarm and normal data transmission signals comprising a data pulse of greater duration than one cycle of the AC power wave form wherein said data pulse is not synced to or dependent upon said AC power wave form;

(e) signal sensing means responsive to data transmissions from each remote station and from said master receiver; and (f) means to reset said timing means upon detection by said signal sensing means of data transmission signals from other remote stations.

19. A remote station as in claim 18 further comprising memory means within said signal generating means for storage of data of an alarm condition when detected at said monitoring means.

20. A remote station as in claim 19 further comprising verification signal detecting means operable to reset said timing means for transmission of a second data transmission of that stored in said memory means.

21. A remote station as in claim 18 wherein each normal data transmission signal comprises a single carrier frequency data pulse and each alarm data transmission signal comprises a modulated single carrier frequency data pulse, said single carrier frequency of the normal data transmission signal being equal to said single carrier frequency of the alarm data transmission signal.

* * * * *